US008876572B2

(12) United States Patent
Martino et al.

(10) Patent No.: US 8,876,572 B2
(45) Date of Patent: Nov. 4, 2014

(54) TOY VEHICLE LAUNCHING RAMP AND LANDING RAMP

(75) Inventors: Anthony M. Martino, Thousand Oaks, CA (US); Kevin Cao, Reseda, CA (US); David Alan Sheltman, Rancho Palos Verdes, CA (US)

(73) Assignee: Mattel, Inc., El Segundo, CA (US)

( * ) Notice: Subject to any disclaimer, the term of this patent is extended or adjusted under 35 U.S.C. 154(b) by 187 days.

(21) Appl. No.: 13/594,320

(22) Filed: Aug. 24, 2012

(65) Prior Publication Data

US 2013/0225040 A1 Aug. 29, 2013

Related U.S. Application Data

(60) Provisional application No. 61/528,571, filed on Aug. 29, 2011.

(51) Int. Cl.
*A63H 29/00* (2006.01)
*A63H 29/24* (2006.01)
*A63H 18/02* (2006.01)

(52) U.S. Cl.
CPC ..... *A63H 29/24* (2013.01); *A63H 18/028* (2013.01); *A63H 18/026* (2013.01)
USPC ..... 446/429

(58) Field of Classification Search
USPC ..... 446/429
See application file for complete search history.

(56) References Cited

U.S. PATENT DOCUMENTS 2,517,084 A 8/1950 Carver
2,611,355 A 9/1952 Ashwood
2,803,922 A 8/1957 Holt
2,860,620 A 11/1958 Effinger, Jr.
3,542,366 A 11/1970 Schocker
3,621,602 A 11/1971 Barcus et al.

(Continued)

FOREIGN PATENT DOCUMENTS

CN 201147636 Y 11/2008
GB 1304638 A 1/1973

(Continued)

OTHER PUBLICATIONS

"Hot Wheels Roll-Up Raceway Track Set", http://www.amazon.com/Hot-Wheels-Roll-Up-Raceway-Track/dp/B00062J9CM, 8 pages.

(Continued)

*Primary Examiner* — Kurt Fernstrom
*Assistant Examiner* — Dolores Collins
(74) *Attorney, Agent, or Firm* — Edell, Shapiro & Finnan LLC

(57) ABSTRACT

A toy vehicle launching ramp and landing ramp is a toy vehicle track set that includes a launching ramp or track portion and a landing or receiving ramp or track portion. The toy vehicle track set also includes a booster or launcher which can propel or launch a toy vehicle onto the launching ramp, into the air, and onto the landing ramp. Further the set includes at least one elongate member with distance indicia, such that a user can measure the distance between the launcher and launching ramp, the launching ramp and receiving ramp, or some combination thereof. The toy vehicle track set enhances the play value of toy vehicle track sets by providing reliable and measurable jumps.

20 Claims, 6 Drawing Sheets

(56) References Cited

U.S. PATENT DOCUMENTS

| | | | |
|---|---|---|---|
| 3,654,728 | A | 4/1972 | Beny et al. |
| 3,693,282 | A | 9/1972 | Adicks et al. |
| 3,905,350 | A | 9/1975 | Becker |
| 4,280,300 | A | 7/1981 | Kulesza et al. |
| 4,389,810 | A | 6/1983 | Green |
| 4,472,905 | A | 9/1984 | Silverman et al. |
| 4,529,389 | A | 7/1985 | Kennedy et al. |
| 4,534,745 | A | 8/1985 | Jones et al. |
| 4,615,223 | A | 10/1986 | Nause |
| 4,715,843 | A | 12/1987 | Ostendorff et al. |
| 4,733,871 | A | 3/1988 | McQueeny et al. |
| 4,767,375 | A | 8/1988 | Fassman |
| 5,141,467 | A | 8/1992 | Crosbie |
| 5,234,216 | A | 8/1993 | Ostendorff |
| 5,637,996 | A | 6/1997 | McDarren et al. |
| 5,666,101 | A | 9/1997 | Cazzani et al. |
| 6,216,600 | B1 | 4/2001 | Verret |
| 6,913,508 | B2 | 7/2005 | Hornsby et al. |
| 7,086,922 | B2 | 8/2006 | Delgado |
| 7,275,975 | B2 | 10/2007 | Trageser et al. |
| 7,285,035 | B1 | 10/2007 | Tullis |
| 7,618,302 | B2 | 11/2009 | Collins et al. |
| 7,815,486 | B2 | 10/2010 | Bernstein et al. |
| 7,857,679 | B2 * | 12/2010 | O'Connor et al. ..... 446/429 |
| 8,256,721 | B2 * | 9/2012 | O'Connor et al. ..... 246/415 A |
| 8,382,553 | B2 * | 2/2013 | O'Connor ..... 446/444 |
| 8,690,632 | B2 * | 4/2014 | O'Connor et al. ..... 446/444 |
| 2007/0099541 | A1 | 5/2007 | Yu et al. |
| 2011/0021110 | A1 | 1/2011 | Hippely et al. |
| 2011/0053456 | A1 | 3/2011 | Ostendorff et al. |
| 2011/0269369 | A1 * | 11/2011 | O'Connor et al. ..... 446/429 |
| 2013/0280987 | A1 * | 10/2013 | Lennon ..... 446/429 |

FOREIGN PATENT DOCUMENTS

| | | | |
|---|---|---|---|
| GB | 2219873 | A | 12/1989 |
| JP | 6063250 | A | 3/1994 |
| WO | 2007/131207 | A2 | 11/2007 |

OTHER PUBLICATIONS

Combined Search and Examination Report for British Patent Application No. GB1215122.1, dated Oct. 24, 2012, 6 pages.

Chinese Office Action corresponding to Chinese Application No. 201210313461.5, dated May 23, 2014, 11 pages.

Preliminary Search Report and Written Opinion for French Patent Application No. 12 57985, dated May 7, 2013, 13 pages.

* cited by examiner

TOY VEHICLE LAUNCHING RAMP AND LANDING RAMP

CROSS-REFERENCE TO RELATED APPLICATION

This application claims priority to and the benefit of U.S. Provisional Patent Application No. 61/528,571, filed Aug. 29, 2011, entitled "Toy Vehicle Launching Ramp and Landing Ramp" the entire disclosure of which is incorporated herein by reference in its entirety.

FIELD OF THE INVENTION

The invention relates generally to toys, and more particularly to a toy vehicle play set that may include a launching ramp spaced a distance apart from a landing ramp. Furthermore, the invention relates to a toy vehicle play set incorporating one or more measuring devices for estimating and adjusting the distance traveled by a vehicle when launched from the launching ramp.

BACKGROUND

Toy vehicle play sets are popular toys which are known to provide entertainment and excitement to an end user. These play sets typically include one or more track configurations intended to guide a toy vehicle, such as a 1/64 scale free-wheeling die-cast toy vehicle. The track configurations may also include a mechanism for propelling the vehicle or call for the vehicle to be propelled by hand.

To bring increased entertainment and excitement to play sets, track configurations may incorporate jumps into these play sets by which a traveling toy vehicle is briefly separated from the track to ultimately rejoin the track at a downstream location, or to enter a second track portion spaced apart from the first track portion. However, these attempts have been limited due to the complexities of ensuring that the launched toy vehicle lands on the second track portion in a proper orientation to thus allow the vehicle to continue its course of travel. Furthermore, these attempts have been limited in that the consistency of the distance traveled by a launched vehicle has varied, causing the vehicle to miss the landing target and/or fall off the track.

Accordingly, a toy vehicle play set is desired which can provide the entertainment and excitement associated with a toy vehicle being launched from a launching ramp at a predetermined desired force and landing safely on a landing ramp. It is further desirable to provide a toy vehicle play set incorporating a measuring apparatus for accurately estimating the desired flight distance of the vehicle, ensuring consistent launching of a vehicle. It is further desirable to provide an apparatus capable of adjusting the distance to be traveled by the vehicle to match the gap created between a launching ramp and a landing ramp. It is also desirable to provide a toy vehicle play set capable of measuring the horizontal and/or vertical distance traveled by a vehicle, in flight, when launched from a launching ramp.

SUMMARY

In one embodiment a toy vehicle track set is provided comprising a launching ramp including a track portion and a launching mechanism coupled to the track portion, wherein the launching mechanism includes a retraction mechanism, a receiver, and an elongate member coupling the receiver to the retraction mechanism, wherein the retraction mechanism includes an actuator, the activation of which results in the retraction of the elongate member and movement of the receiver toward the track portion. The track set further comprises a landing ramp spaced apart from the launching ramp and having a track portion configured to receive a toy vehicle thereon. In practice, a vehicle is placed onto or in front of the receiver of the launching ramp, and the receiver is withdrawn to arm the launching mechanism. The actuator is then depressed, causing the retraction mechanism to move the receiver toward the track portion, launching the toy vehicle upon the launching ramp track portion, through the air, and onto the landing ramp track portion.

In one embodiment, the elongate member is a measuring device that can be used by the user to determine the distance between the receiver and the track portion prior to retraction of the elongate member.

In other embodiments, the launching ramp or landing ramp includes a retractable measure with distance indicia thereon, the retractable measure being extendible from either the landing ramp or launching ramp and coupleable with the opposing ramp via a coupler, thereby permitting the measurement of a distance between the launching ramp and the landing ramp.

In still another embodiment, the launching mechanism includes a locking mechanism, wherein the locking mechanism prevents the retraction mechanism from retracting the elongate member until the actuator is actuated.

In yet another embodiment, the track portions include sidewalls extending from opposite edges of the launching ramp such that a toy vehicle may travel therebetween. However, in other embodiments, the landing ramp also includes a shell disposed at least partially around the landing ramp, such that the shell may direct a launched vehicle onto the landing ramp.

In an alternative embodiment a toy vehicle track set comprises a launching track portion having a ramp and a launcher that receives a toy vehicle and propels the toy vehicle along the ramp, the launcher including a receiving member that receives a toy vehicle and a retraction mechanism that moves the receiving member from a withdrawn position to a retracted position, the receiving member including a distance measuring portion that can be used to determine the distance between the receiving member in its withdrawn position and the ramp. The track set further comprises a receiving track portion having a ramp configured to receive the toy vehicle propelled from the launching ramp.

In other embodiments, the launcher, for the toy vehicle track set above, includes a locking system configured to retain the receiver in a withdrawn position. In some of these embodiments, the locking system is configured to allow the receiver to move away from the ramp of the launching track portion, but not allow the receiver to move towards the ramp of the launching track portion. Further, in at least some other embodiments which include the locking system, the launcher also includes an actuator that, upon actuation, unlocks the locking mechanism, allowing the retraction mechanism to move the receiver from a withdrawn position to a retracted position.

In some embodiments where the launcher, for the toy vehicle track set above, includes a locking system and a actuator, as addressed above, the retraction mechanism can move the receiver to other positions between the retracted position and withdrawn position recited above, such as a second retracted position disposed between the withdrawn position and the first retracted position. For example, in some of these embodiments, the retraction mechanism moves the receiver to the second retracted position if the actuator is moved from an actuated position to a non-actuated position prior to the receiver moving to the first retracted position.

In still further embodiments of the toy vehicle track set, one of the launching track portion or the receiving track portion includes a retractable measure that can be extended between the launching track portion and the receiving track portion to measure the distance therebetween. In other embodiments, the retraction mechanism of the toy vehicle track set comprises a torsion spring, a torsion bar, a coil spring, a recoil spring, an elastic binder, derivatives thereof, or combinations thereof.

According to another alternative embodiment, a toy vehicle track set comprises a launching track portion that includes a ramp and a booster configured to propel a toy vehicle along the track portion. The toy vehicle track set of this embodiment also comprises a first elongate member including distance indicia and a landing track portion including a ramp, wherein the launching track portion and landing track portion are coupled together by a second elongate member, the second elongate member also including distance indicia.

In other embodiments, the booster for the toy vehicle track set above includes a retraction mechanism, wherein the retraction mechanism is configured to move the first elongate member from an extended position to a retracted position. In some of these embodiments, the retraction mechanism includes a bias member configured to bias the first elongate member in a retracted position, a locking system configured to lock the first elongate member in a extended position, and an actuator configured to unlock the locking system, such that the bias member can cause the retraction mechanism to move the first elongate member from an extended position to a retracted position.

In other embodiments, the second elongate member for the toy vehicle track set above is permanently coupled to and extendible from either the landing track portion or the launching track portion and removably coupled to the other.

Other objects, features and advantages of the invention will be understood more readily after consideration of the Detailed Description taken in connection with the accompanying drawings.

DETAILED DESCRIPTION

Figure 1:
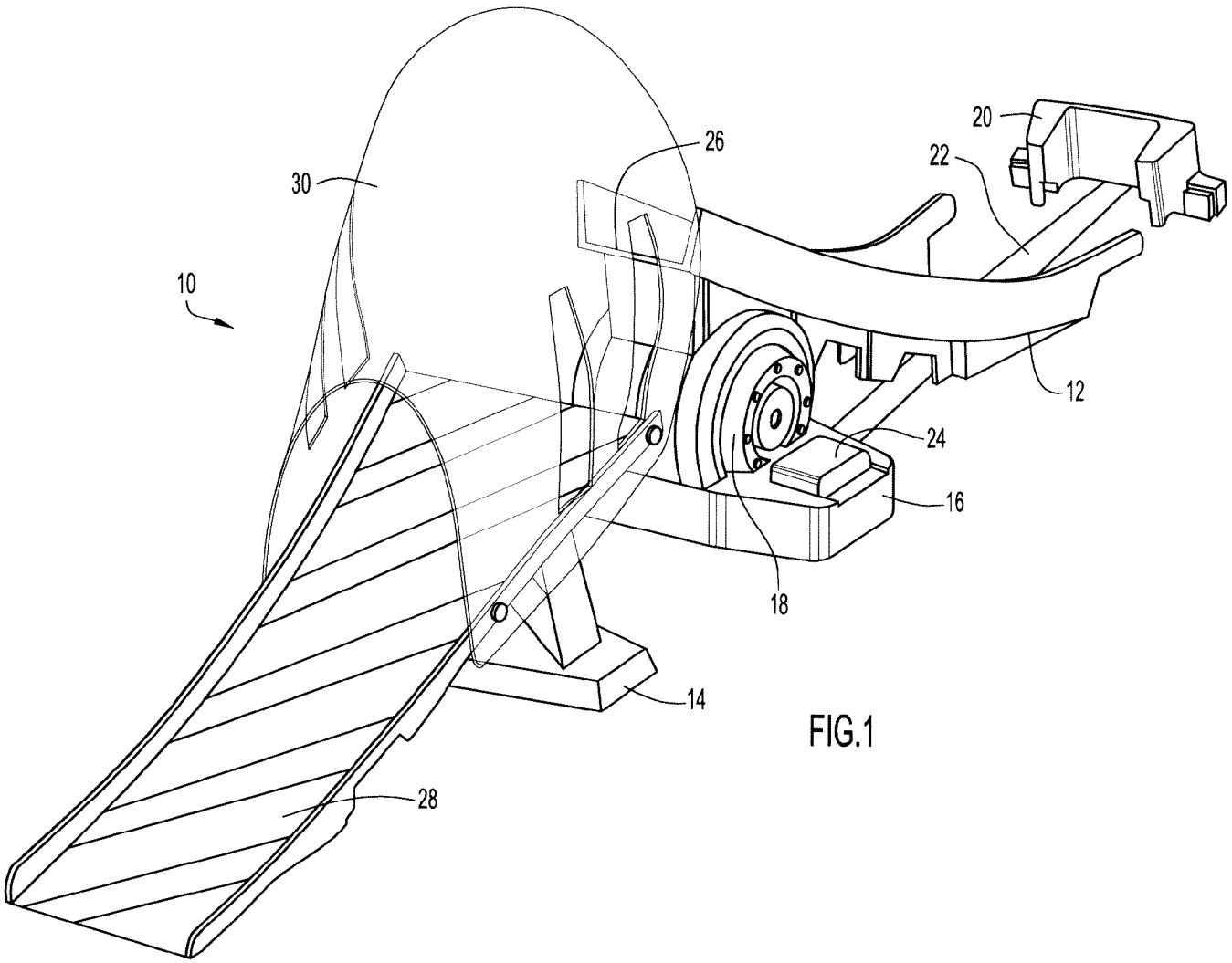
FIG. 1 provides a side perspective view of a toy vehicle track set in accordance with an embodiment of the present invention.

FIG. 1 provides a rear perspective view of a toy vehicle track set 10 in accordance with an embodiment of the present invention, including a launching track portion or ramp 12 and a landing track portion or ramp 14. The launching ramp 12 may be or comprise a track portion 26 and a launching mechanism 16. For the purposes of this application, the launching mechanism may also be referred to as a booster or launcher. The track portion 26 may be inclined, flat, or curved and may be bounded by opposite side walls on its lateral edges. Additionally, the track portion 26 may be substantially wider at its bottom edge than at its top edge and may taper from its bottom edge to its top edge. The launching mechanism (or booster/launcher) 16 may include a retraction mechanism 18, a receiver 20, and an elongate member 22 coupling the receiver 20 to the retraction mechanism 18. The receiver 20 is configured to accept or receive a toy vehicle 32 (see FIG. 2), about the rear and at least one partial side of the vehicle 32 and may articulate with respect to launcher 16.

Figure 6:
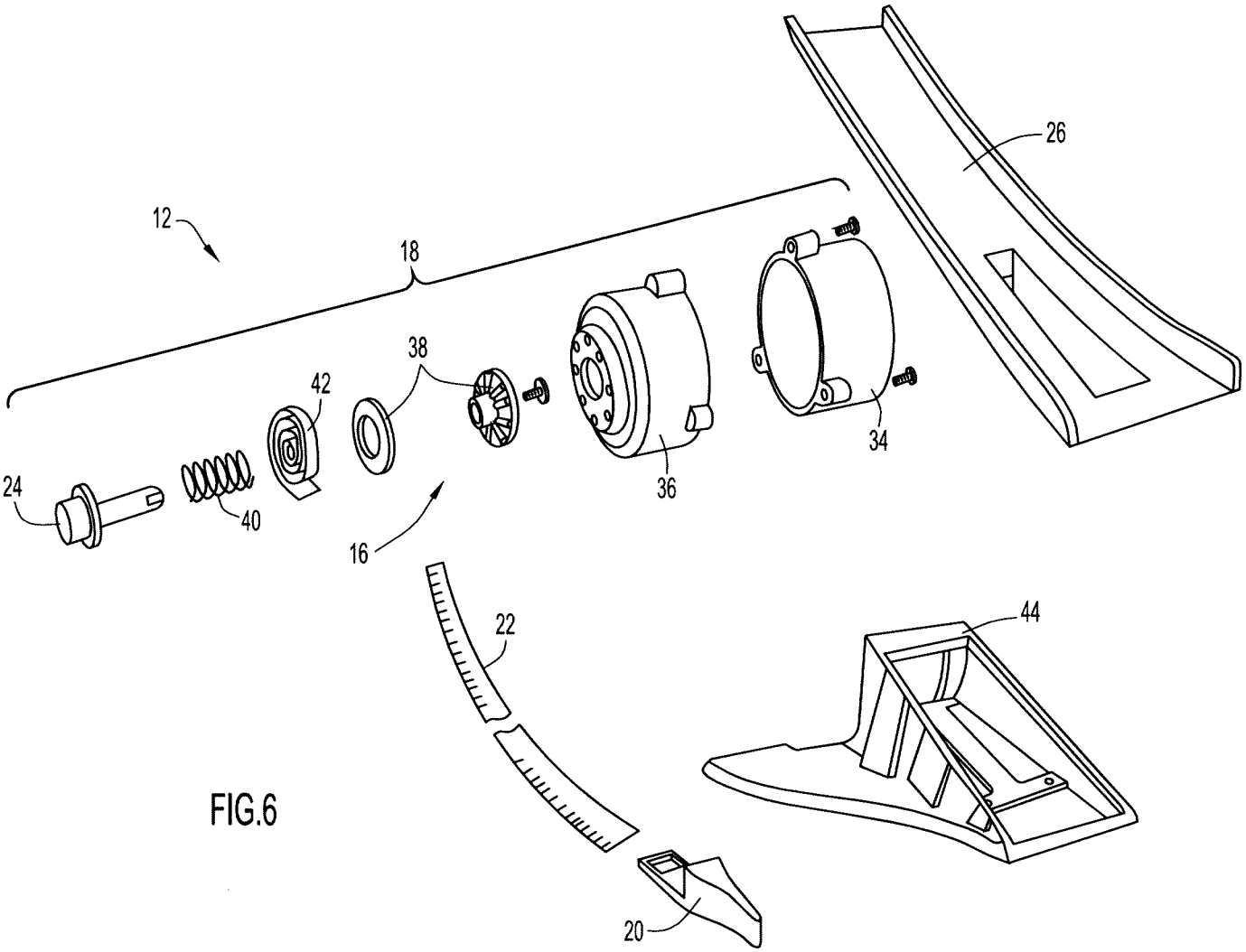
FIG. 6 provides an exploded view of an element of a toy vehicle track set in accordance with an embodiment of the present invention.

In some exemplary embodiments, a vehicle 32 may be launched by withdrawing, or otherwise moving, receiver 20 (including a vehicle 32 received therein or thereon) away from track portion 26, and subsequently releasing the receiver 20, so that the receiver 20 may be drawn back or retracted towards the track portion 26. The retraction mechanism 18 is configured to retract the elongate member 22, thus moving the receiver 20 toward the launching ramp track portion 26. Alternatively, as best seen in FIG. 6, the retraction mechanism 18 may comprise a locking system 38 and actuator 24. The locking system 38 may be configured to retain the elongate member 22 in the withdrawn position until it is released by compressing the actuator 24. Activation of the actuator 24 results in the retraction of the elongate member 22, thereby causing the receiver 20 and accompanying vehicle 32, to be moved towards track portion 26. In addition, the elongate member 22 may contain distance indicia thereon for selecting a desired launching distance. The launching distance may correlate with a vehicle flight distance. Thus, a user may launch a vehicle 32 a distance corresponding to the gap created between the launching ramp 12 and landing ramp 14 by withdrawing the elongate member 22 to the indicia which matches the length of the gap.

In some embodiments, the retraction mechanism 18 may be configured to allow for varied retraction forces dependent on where receiver 20 is situated with respect to the track portion 26. For example, the retraction mechanism 18 may comprise a resilient member configured to increase retraction forces as the receiver 20 is moved further away from the track portion 26. Regardless of whether the force applied is consistent or varied, the retraction mechanism 18 may be configured to impart substantially similar forces on receivers 20 retracted from substantially the same distance. Accordingly, consistently withdrawing the receiver 20 to the same point may ensure that vehicle 32 is consistently launched the same distance. As mentioned above, in some embodiments, elongate member 22 may include indicia which signify how far a vehicle 32 will be launched if withdrawn to certain points. In other words, elongate member 22 may substantially resemble a tape measure, but the indicia included thereon may be spaced at either varied or constant intervals, instead of strictly constant intervals, and may represent launch distances instead of lengths.

The track set 10 further comprises a landing ramp 14 which may be or comprise a track portion 28 configured to receive a toy vehicle 32 thereon. The track portion 28 may, similar to track portion 26, may be inclined, flat, or curved and may be bounded by opposite side walls on its lateral edges. However, in contrast with track portion 26, track portion 28 may be substantially wider at its top edge than at its bottom edge. The landing ramp 14 may further contain a shell 30 configured to partially encapsulate at least a portion of the landing ramp 14 and aid in directing the toy vehicle 32 onto the track portion 28 of landing ramp 14.

In practicing one embodiment of the invention, a vehicle 32 is placed onto or in front of the receiver 20 of the launching ramp 12, and the receiver 20 is withdrawn, with the vehicle 32, to arm the booster 16. Once withdrawn, the locking system 38 (see FIG. 6) retains the receiver 20 a distance from the track portion 26. Then, a user depresses an actuator 24 situated on the booster 16, releasing the locking system 38 and retracting the receiver 20 and accompanying vehicle 32 towards the track portion 26. The forward momentum created by the retraction mechanism 18 thrusts the vehicle 32 onto and over the launching ramp 12, through the air, along the pathway indicated by arrows 50 (See FIG. 2) and onto the track portion 28 of the landing ramp 14.

Figure 2:
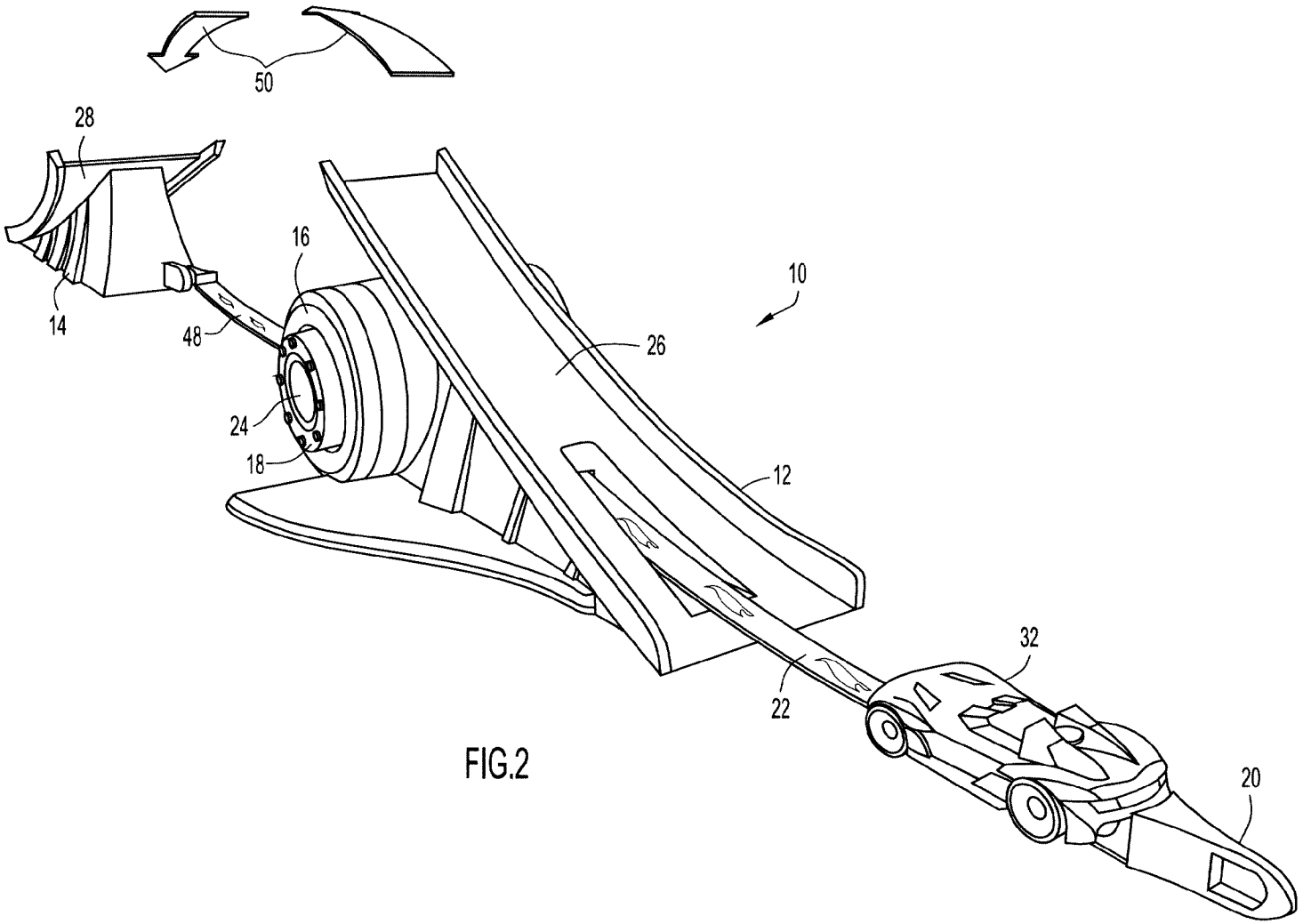
FIG. 2 provides a front perspective view of a toy vehicle track set in accordance with an embodiment of the present invention.

FIG. 2 provides a front perspective view of a toy vehicle track set 10 in accordance with an embodiment of the present invention. Further detailed in FIG. 2 are an alternative embodiment of the receiver 20, in the withdrawn position, configured to contact a portion of the rear of the vehicle 32, as well as a retractable measure 48 situated between the launching ramp 12 and landing ramp 14. The retractable measure 48 contains distance indicia thereon, thereby permitting the measurement of a distance between the launching ramp and the landing ramp. The retractable measure 48 may be extendible from the landing ramp 14, the launching ramp 12, or both, and may be coupleable with either ramp via any desirable coupler or fastener.

Figure 3B:
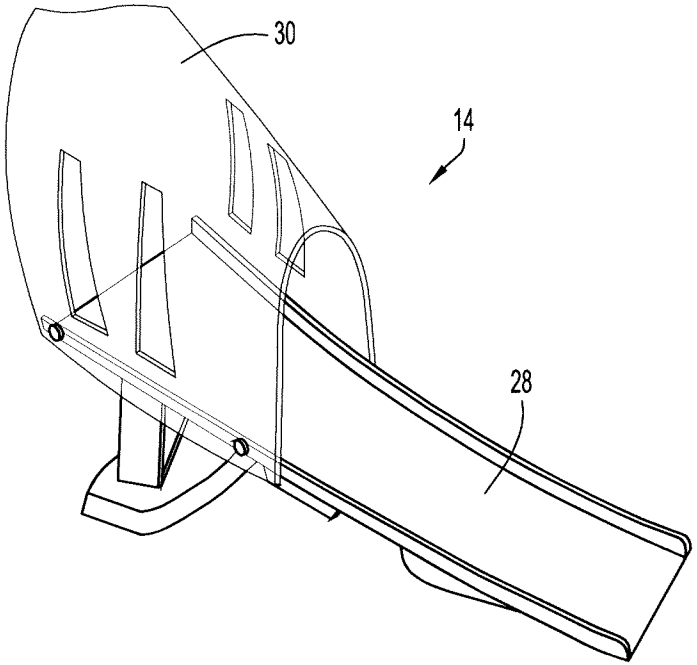
FIG. 3B provides a side perspective view of an element of a toy vehicle track set in accordance with an embodiment of the present invention.
Figure 3A:
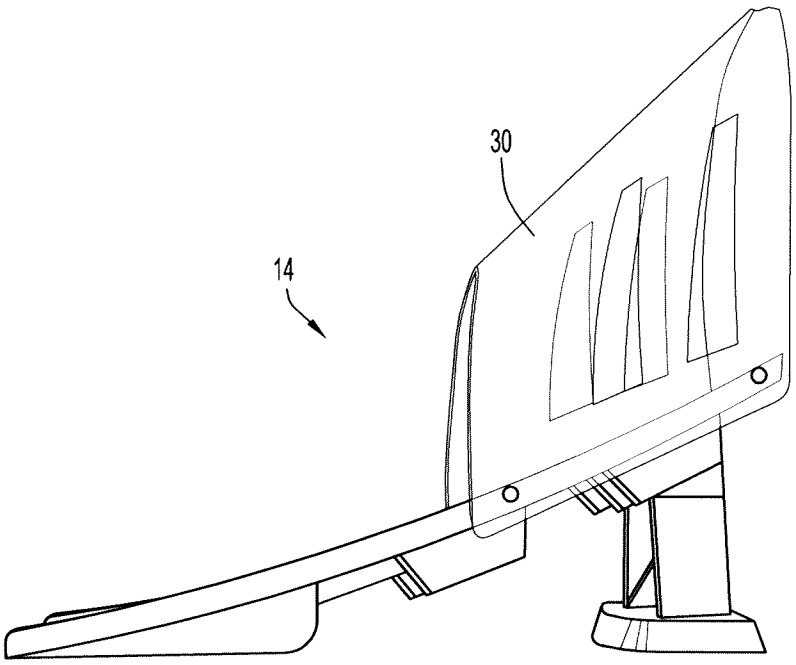
FIG. 3A provides a side view of an element of a toy vehicle track set in accordance with an embodiment of the present invention.

FIGS. 3A and 3B provide a side view and perspective view, respectively, of an element of a toy vehicle track set 10 in accordance with an embodiment of the present invention. More particularly, FIGS. 3A and 3B depict a landing ramp 14 including a shell 30 affixed to and at least partially encapsulating a portion of the track portion 28. Shell 30 may aid in directing a launched vehicle 32 onto the track portion 28 of landing ramp 14. In this embodiment, the shell 30 is tapered, with a broad opening configured to receive the vehicle 32. In various other embodiments, the shape, length and/or placement of the shell 30 may be varied for optimal performance or as desired.

Figure 4:
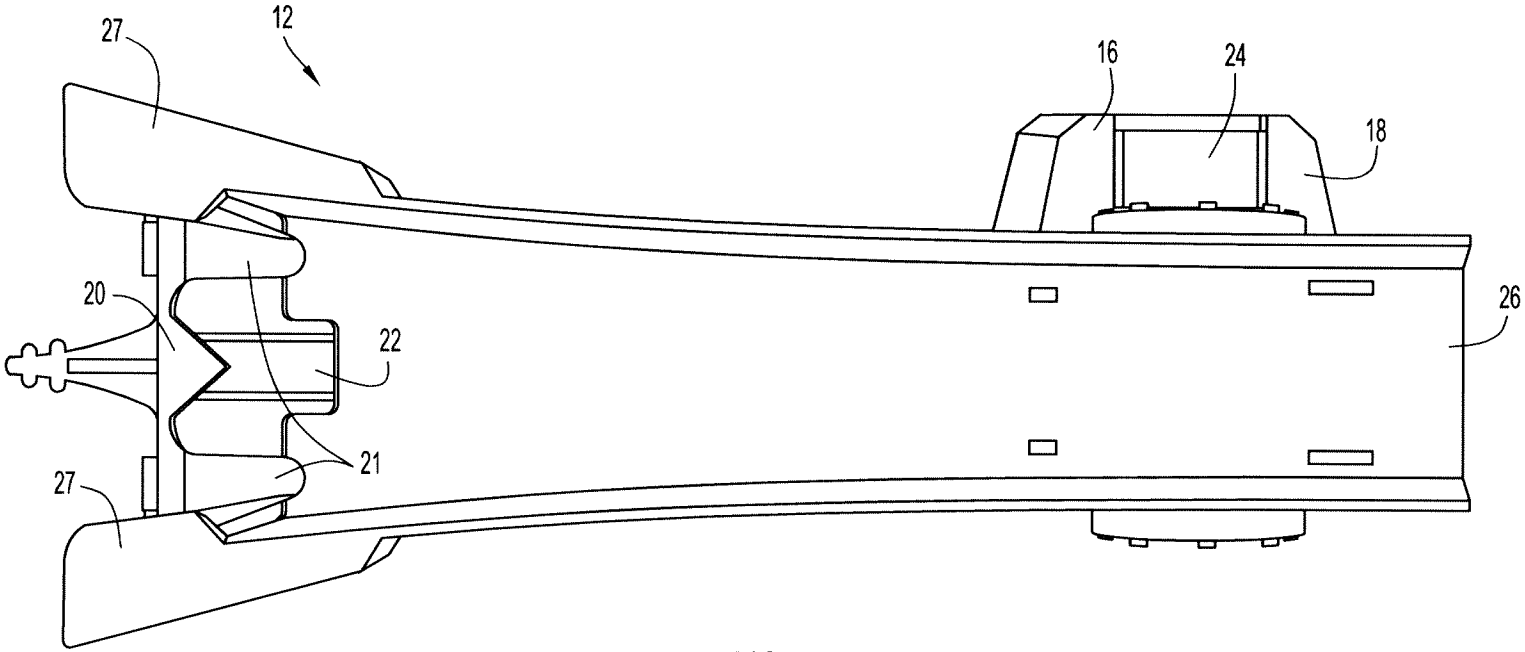
FIG. 4 provides a top view of an element of a toy vehicle track set in accordance with an embodiment of the present invention.

FIG. 4 provides a top view of an element of a toy vehicle track set 10 in accordance with an embodiment of the present invention. FIG. 4 depicts a launching ramp 12 showing a receiver 20 and an elongate member 22 in the retracted position. As seen, receiver 20 may, in some embodiments, include retainer members 21. Retainer members 21 may project from either or both lateral edges of receiver 20 and may be configured to receive the side portion of a vehicle 32 to help ensure it remains in or on receiver 20 during any motion thereof. Also as seen in FIG. 4, launching ramp 14 may include guide members 27 that may direct or otherwise guide a vehicle 32 onto track portion 28. Guide members 27 may interiorly receive retainer members 21 in order to direct a vehicle 32 onto track portion 26.

FIG. 4 further depicts a launching ramp 14 including track portion 26 and launching mechanism 16 comprising a retraction mechanism 18 and an actuator 24. In the exemplary embodiment depicted in FIG. 4, the actuator is a push button actuator. However, in other embodiments, actuator 24 may be any desirable actuator.

Figure 5:
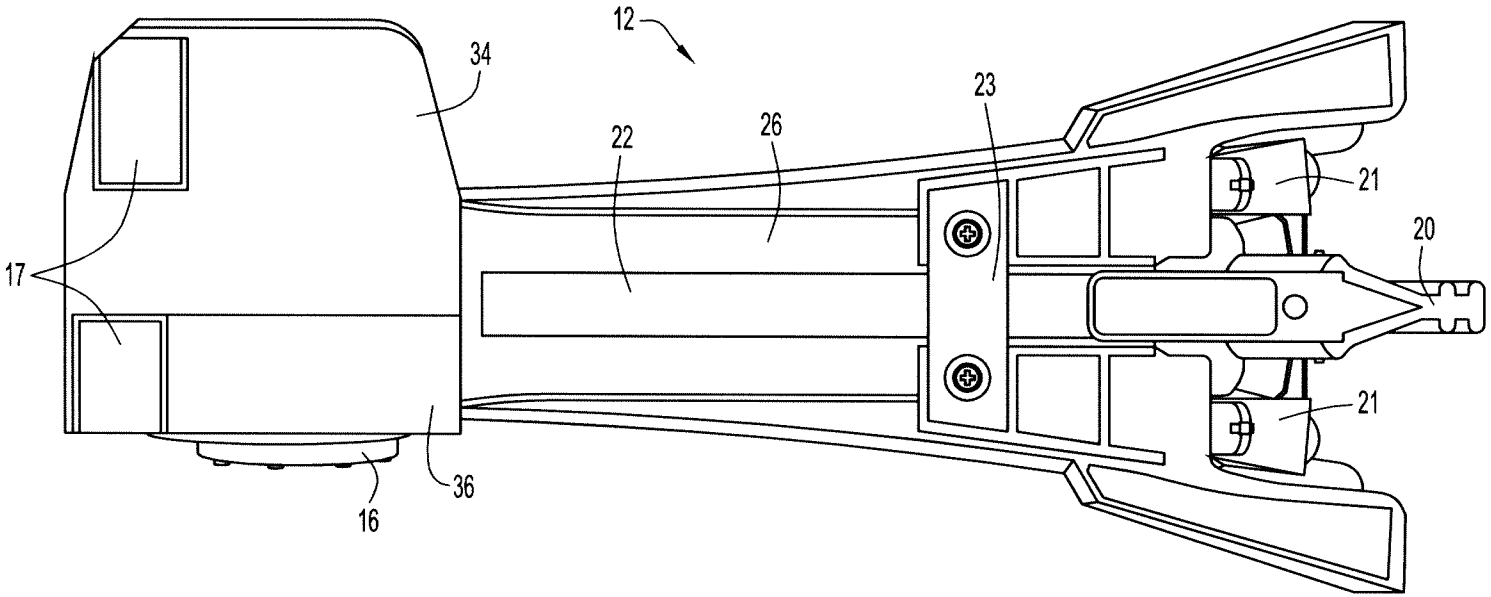
FIG. 5 provides a bottom view of an element of a toy vehicle track set in accordance with an embodiment of the present invention.

FIG. 5 provides a bottom view of an element of a toy vehicle track set 10 in accordance with an embodiment of the present invention. FIG. 5 depicts a launching ramp 12 with a receiver 20 and an elongate member 22 in a retracted position. As can be seen in the exemplary embodiment of FIG. 5, a portion of the receiver 20, such as retainer members 21, may be disposed above the track portion 26 when the receiver 20 is in a retracted position while the remainder of receiver 20 may be disposed below track portion 26. Thus, receiver 20 may be prevented from being retracted past a certain point or position, such as the retracted position depicted in FIG. 5.

Additionally, track 26 may include a securing member 23 on its lower surface which may act to secure or position elongate member 22 substantially in the center of track 26, substantially adjacent to its underside. Securing member 23 may prevent, or help to prevent, elongate member 22 from twisting, turning or otherwise undesirably moving in a manner that may prevent withdrawal or retraction. In the exemplary embodiment of FIG. 5, the elongate member 22 is seen engaged with a retraction mechanism 18, which is disposed within a housing 34 and a cover 36 for the housing 34. Housing 34 and cover 36 may also include grip portions 17 which may engage a support surface below the toy vehicle track set 10 and resist movement with respect to the support surface below.

FIG. 6 provides an exploded view of an element of a toy vehicle track set 10 in accordance with an embodiment of the present invention. The exploded view of a launching ramp 12 illustrates internal components of a launching mechanism 16, as well as a base 44 configured to support a track portion 26. The launching mechanism 16 comprises a retraction mechanism 18, a receiver 20, and an elongate member 22 coupling the receiver 20 to the retraction mechanism 18. The retraction mechanism 18 comprises a housing 34 for retaining various components of the launching mechanism 16, including a locking mechanism 38, a recoil member 40, a bias member 42, and an actuator 24. The components of retraction mechanism 18 are retained in the housing 34 by a cover 36, but the cover 36 includes an opening for so that the actuator 24 may be exposed exteriorly of the housing 34 and cover 36.

The components of the retraction mechanism 18 are operably connected to each other such that retraction mechanism 18 may function in accordance with the objects and scope of the invention. For example, in the exemplary embodiment of FIG. 6, the bias member 42 is operably coupled to the elongate member 22 so that it may drive retraction of the elongate member 22 and accompanying receiver 20 towards track portion 26. Thus, as a user withdraws, pulls back, or otherwise moves the receiver 20 away from the retraction mechanism 18, the biasing member 42 may coil, retract, or otherwise store energy, such that it may bias the receiver 20 (and elongate member 22) towards a retracted position. In some embodiments, the biasing member 42 might automatically retract the receiver 20 as soon as it is released, but in the exemplary embodiment depicted in FIG. 6, locking mechanism 38 prevents or "locks" the biasing member 42 from automatically retracting receiver 20, at least until actuator 24 is actuated. However, in some embodiments the locking system 38 may retain or "lock" the elongate member 22 by simply preventing it from retracting. Thus, in some instances even though locking system 38 may be "locking" elongate member 22, elongate member may still be able to move, but elongate member will only be able to be further withdrawn, not retracted. Regardless, once a user retracts receiver 20, the user may release receiver 20 without it immediately retracting.

Once the user is prepared to release the receiver from a withdrawn position (i.e., launch a vehicle 32), a user may press, or otherwise actuate, actuator 24. Such actuation may, in turn, cause actuator 24 to engage and unlock lock mechanism 38, so that the lock mechanism 38 allows the energy stored in biasing member 42 may be released, causing elongate member 22 and receiver 20 to be retracted. In some embodiments, actuating actuator 24 may fully retract elongate member 22 and receiver 20, but in other embodiments, retraction mechanism 18 may only retract elongate member 22 and receiver 20 for as long as actuator 24 is engaged.

For example, recoil member 40 may be operably coupled to actuator 24 and biased to keep actuator 24 in an non-actuated position so that that the actuator 24 is not engaging and unlocking the locking mechanism 38 unless actuator 24 is presently actuated. Thus, a brief or momentary actuation of actuator 24 could partially retract elongate member 22 and receiver 20 for that same amount of time. However, in other embodiments, recoil member 40 may be configured to permit full retraction of elongate member 22 and receiver 20 in response to even a momentary actuation of actuator 24. Either way, recoil member 40 may ensure (by moving actuator 24 into a non-actuated position) that locking mechanism 38 locks the biasing member 42 unless actuator 24 is being, or has recently been, pressed. In other words, recoil member 40 may automatically return actuator 24 to a non-actuated position after each actuation, thereby ensuring locking mechanism 38 will continue to lock retraction mechanism 18 for any subsequent withdrawals.

The vehicle track set 10 may be fabricated from any suitable material, or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

The bias member 42 and recoil member 40 are each defined herein as a spring which expands/rotates (and recovers) in at least one axis, and may include, but is not limited to, a spring, a resilient plastic, memory foam, or a rubber. Each of the bias member 42 and the recoil member 40 may be fabricated from any suitable material, or combinations of materials, such as supple natural or synthetic materials including, but not limited to, plastic, metal, elastomers, polyester, rubber, derivatives thereof, and combinations thereof.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While the invention has been described in detail and with references to specific embodiments thereof, it will be apparent to one skilled in the art that various changes and modifications can be made therein without departing from the spirit and scope of the invention. Thus, it is intended that the present invention covers the modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. A toy vehicle track set, comprising:

a launching ramp including:

a track portion; and a launching mechanism coupled to the track portion, the launching mechanism including a retraction mechanism, a receiver, and an elongate member coupling the receiver to the retraction mechanism, the retraction mechanism configured to retract the elongate member and the receiver toward the track portion; and a landing ramp, spaced apart from the launching ramp, including:

a track portion configured to receive a toy vehicle thereon, wherein retraction of the elongate member and the receiver results in launching the toy vehicle along the track portion of the launching ramp, through the air, and onto the track portion of the landing ramp.

2. The toy vehicle track set of claim 1, wherein the elongate member is a measuring device that can be used by the user to determine the distance between the receiver and the track portion of the launching ramp prior to retraction of the elongate member.

3. The toy vehicle track set of claim 1, wherein the elongate member is a first elongate member, and the launching ramp includes a second elongate member with distance indicia thereon, the second elongate member being extendible from the launching ramp and coupleable with the landing ramp via a coupler, thereby permitting the measurement of a distance between the launching ramp and the landing ramp.

4. The toy vehicle track set of claim 3, wherein the second elongate member is detachably coupled to the landing ramp.

5. The toy vehicle track set of claim 1, wherein the elongate member is a first elongate member, and the landing ramp includes a second elongate member with distance indicia thereon, the second elongate member being extendible from the landing ramp and coupleable with the launching ramp via a coupler, thereby permitting the measurement of a distance between the launching ramp and the landing ramp.

6. The toy vehicle track set of claim 1, wherein the launching mechanism further comprises:

an actuator, wherein actuation of the actuator causes the retraction mechanism to retract the elongate member and the receiver towards the track portion of the launching ramp.

7. The toy vehicle of claim 6, wherein the launching mechanism further comprises:

a locking mechanism, wherein the locking mechanism prevents the retraction mechanism from retracting the elongate member until the actuator is actuated.

8. The toy vehicle track set of claim 1, wherein the track portions of the launching and landing ramps further comprise:

sidewalls extending from opposite edges of the launching ramp such that a toy vehicle may travel therebetween.

9. The toy vehicle track set of claim 1, wherein the retraction mechanism of the toy vehicle track set comprises a torsion spring, a torsion bar, a coil spring, a recoil spring, an elastic binder, derivatives thereof, or combinations thereof.

10. The toy vehicle track set of claim 1, wherein the elongate member is detachably coupled to the launching mechanism.

11. A toy vehicle track set, comprising:

a launching track portion having a ramp and a launcher that receives a toy vehicle and propels the toy vehicle along the ramp, the launcher comprising:

a receiver that receives a toy vehicle; and a retraction mechanism that moves the receiver from a withdrawn position to a retracted position, the receiver including a distance measuring portion that can be used to determine the distance between the receiver in its withdrawn position and the ramp of the launching track portion; and a receiving track portion having a ramp configured to receive the toy vehicle propelled from the launching ramp.

12. The toy vehicle track set of claim 11, wherein the launcher further comprises:

a locking system configured to retain the receiver in the withdrawn position.

13. The toy vehicle track set of claim 12, wherein the locking system is configured to allow the receiver to move away from the ramp of the launching track portion, but not allow the receiver to move towards the ramp of the launching track portion.

14. The toy vehicle track set of claim 12, wherein the launcher further comprises:

an actuator that, upon actuation, unlocks the locking mechanism, allowing the retraction mechanism to move the receiver from the withdrawn position to the retracted position.

15. The toy vehicle track set of claim 14, wherein the retracted position is a first retracted position, the first retracted position being proximate to the ramp, and the retraction mechanism also moves the receiver from the withdrawn position to a second retracted position disposed between the withdrawn position and the first retracted position.

16. The toy vehicle track set of claim 15, wherein the retraction mechanism moves the receiver to the second retracted position if the actuator is moved from an actuated position to a non-actuated position prior to the receiver moving to the first retracted position.

17. The toy vehicle track set of claim 11, wherein one of the launching track portion or the receiving track portion includes a retractable measure that can be extended between the launching track portion and the receiving track portion to measure the distance therebetween.

18. A toy vehicle track set comprising:

a launching track portion comprising:

a ramp; and a booster configured to propel a toy vehicle along the track portion and comprising a first elongate member including distance indicia; and a landing track portion including a ramp, wherein the launching track portion and landing track portion are coupled together by a second elongate member, the second elongate member including distance indicia.

19. The toy vehicle track set of claim 18, wherein the booster further comprises:

a retraction mechanism, wherein the retraction mechanism is configured to move the first elongate member from an extended position to a retracted position.

20. The toy vehicle track set of claim 19, wherein the retraction mechanism further comprises:

a bias member configured to bias the first elongate member in a retracted position;

a locking system configured to lock the first elongate member in a extended position; and an actuator configured to unlock the locking system, such that the bias member can cause the retraction mechanism to move the first elongate member from an extended position to a retracted position.

* * * * *